US006186104B1

(12) United States Patent
Torii et al.

(10) Patent No.: US 6,186,104 B1
(45) Date of Patent: Feb. 13, 2001

(54) VARIABLE VALVE TIMING CONTROLLING APPARATUS FOR INTERNAL COMBUSTION ENGINE

(75) Inventors: Akira Torii; Yoshinori Ichinosawa, both of Kanagawa (JP)

(73) Assignee: Unisia Jecs Corporation, Atsugi (JP)

( * ) Notice: Under 35 U.S.C. 154(b), the term of this patent shall be extended for 0 days.

(21) Appl. No.: 09/414,640

(22) Filed: Oct. 8, 1999

(30) Foreign Application Priority Data

Oct. 8, 1998 (JP) ..... 10-285800
Sep. 9, 1999 (JP) ..... 11-255131

(51) Int. Cl.[7] ..... F01L 1/344
(52) U.S. Cl. ..... 123/90.17; 123/90.31
(58) Field of Search ..... 123/90.15, 90.17, 123/90.31; 74/568 R

(56) References Cited

U.S. PATENT DOCUMENTS

| | | | | |
|---|---|---|---|---|
| 5,184,578 | | 2/1993 | Quinn, Jr. et al. | 123/90.17 |
| 5,289,805 | | 3/1994 | Quinn, Jr. et al. | 123/90.17 |
| 5,722,356 | | 3/1998 | Hara | 123/90.17 |
| 5,816,204 | * | 10/1998 | Moriya et al. | 123/90.17 |
| 6,129,060 | | 10/2000 | Koda | 123/90.17 |
| 6,129,062 | | 10/2000 | Koda | 123/90.17 |

FOREIGN PATENT DOCUMENTS

| | | |
|---|---|---|
| 1-92504 | 4/1989 | (JP) . |
| 8-121123 | 5/1996 | (JP) . |
| 9-280017 | 10/1997 | (JP) . |

* cited by examiner

*Primary Examiner*—Weilun Lo
(74) *Attorney, Agent, or Firm*—Foley & Lardner

(57) ABSTRACT

In a variable valve timing controlling apparatus for an internal combustion engine having an engine valve, the controlling apparatus having:a rotational body rotated in synchronization with an engine crankshaft;a camshaft, one end thereof being inserted into the rotational body and the camshaft including a cam located on an outer periphery of the camshaft to open the engine valve against a spring force exerted by a valve spring of the engine valve; a phase changing device interposed between the rotational body and the one end of the camshaft to hydraulically vary a relative rotational phase between the rotational body and the camshaft; and a hydraulic pressure circuit to relatively supply and drain a hydraulic pressure to and from at least one retardation angle hydraulic pressure chamber and at least one advance angle hydraulic pressure chamber, each hydraulic pressure chamber being formed within the rotational body to drive the cam phase changing device, an interrupting mechanism is provided to interrupt a hydraulic pressure passage of the hydraulic pressure circuit to supply the hydraulic pressure to at least one of the advance angle and retardation angle hydraulic pressure chambers for a time duration which corresponds to a torque peak region of a rotation variation torque developed on the camshaft.

18 Claims, 14 Drawing Sheets

VARIABLE VALVE TIMING CONTROLLING APPARATUS FOR INTERNAL COMBUSTION ENGINE

BACKGROUND OF THE INVENTION a) Field of the Invention

The present invention relates to an internal combustion engine in which a variable valve timing controlling apparatus is installed which varies open and closure timings of one or both of an intake valve or intake valves and an exhaust valve or exhaust valves according to an engine driving condition.

b) Description of the Related Art

A Japanese Patent Application First Publication No. Heisei 9-280017 published on Oct. 28, 1997 exemplifies a first previously proposed variable valve timing controlling apparatus of a vane type.

The first previously proposed variable valve timing controlling apparatus of the vane type disclosed in the above-identified Japanese Patent Application First Publication includes a timing pulley having a cylindrical housing in which a vane fixed to an end of a camshaft is rotatably housed and an advance-angle hydraulic pressure chamber and a retardation-angle hydraulic pressure chamber defined between two approximately trapezoid shaped partitioning wall sections and two blade portions. The cylindrical housing of the timing pulley has an opening enclosed by a front cover and a rear cover. The trapezoid shaped partitioning wall sections are located on an inner peripheral surface of the housing and mutually projected toward their inner directions from a radial direction thereof.

Then, a hydraulic pressure (working oil pressure) is supplied or exhausted (drained) through a hydraulic pressure circuit into or from each of the advance-angle hydraulic pressure chamber and the retardation-angle hydraulic pressure chamber according to an engine driving condition so that the related hydraulic pressure causes the vane to rotate in either the normal direction or reverse direction. As the result, a relative rotational phase between the timing pulley and the camshaft is varied to enable the variation of open-and-closure timings of an intake valve of the engine.

However, in the first previously proposed variable valve timing controlling apparatus described above, each hydraulic passage in a hydraulic circuit to supply the hydraulic pressure into either the advance angle hydraulic pressure chamber or the retardation angle hydraulic pressure chamber is communicated with a main gallery which supplies a lubricating oil into each slide portion of the engine, viz, in an open circuit configuration. A positive or negative revolution variation torque is, hence, developed so that a rotation of the vane becomes unstable. That is to say, it is well known that a rotation variation (fluctuating) torque (in a form of an alternating torque) in a normal direction or reverse direction due to a presence in a spring force of a valve spring disposed along a stem of each engine valve is developed during an engine operation.

If a large rotation variation torque is acted upon the camshaft during a rotational drive of the vane in an advance or retardation angle side, the vane is rotated in the advance angle side progressively repeating the normal rotation and the reverse rotation toward the advance angle side or the retardation angle side (as denoted by a broken line of FIG. 8B) since the hydraulic pressure supplied to the advance angle hydraulic chamber is pressed against a reaction force exerted by the normal directional variation torque and which is acted upon in an opposite direction to the rotation direction. Hence, since the camshaft also carries out the relative rotation to the timing pulley repeating the normal rotation and the reverse rotation, a control response characteristic of the valve open-and-closure timing control for the intake valve is reduced.

Especially, when the vane is rotated in the advance-angle direction, a quick switching action is demanded since the vane advance-angle direction rotation means generally the switching from an engine idling state to a normal driving state. However, during a transition from a low-engine-speed region to a middle-engine-speed region, it becomes easy for the vane to be reversed due to a reaction force of the rotation variation torque.

A Japanese Patent Application First Publication No. Heisei 8-121123 published on May 14, 1996 exemplifies a second previously proposed variable valve timing controlling apparatus of the vane type.

In the second previously proposed variable valve timing controlling apparatus, a pilot-type check valve is installed which includes a check valve and a pilot valve, both valves being extended in an inside portion of the vane and being operated to limit a reverse flow of the drive hydraulic pressure supplied to either the advance-angle or the retardation-angle hydraulic chamber within the hydraulic passage so as to prevent the reverse rotation of the vane due to the rotation variation torque.

SUMMARY OF THE INVENTION

However, since the pilot-type check valve described in the BACKGROUND OF THE INVENTION is operated directly utilizing the internal hydraulic pressure supplied to each hydraulic pressure chamber without exception, i.e., according to the variation in the internal hydraulic pressure.

Hence, a slight delay in time easily (a slight time lag) occurs until a check ball constituting the check valve is moved due to a pressure developed from a maximum rotation variation torque and this causes a reduction in a response characteristic of the check valve. In addition, when the reaction force of the variation torque is released, the check ball is, in turn, moved in the opposite direction to a valve body portion of the check valve to open the hydraulic passage. Hence, a time lag due to a forward-and-rearward movement of the check ball causes a reduction of the response characteristic to open and close the hydraulic passage.

Furthermore, the check ball itself provides a resistance of the oil flow within the hydraulic passage and may provide an obstruction against a quick boosting of the hydraulic pressure supplied to either the advance angle or retardation angle hydraulic pressure chamber.

It is, therefore, an object of the present invention to provide an improved variable valve timing controlling apparatus which prevents the reverse rotation of the vane due to the rotation variation torque and which provides the high control response characteristic of the valve open-and-closure timing control.

The above-described object can be achieved by providing a variable valve timing controlling apparatus for an internal combustion engine having an engine valve, comprising: a rotational body rotated in synchronization with an engine crankshaft; a camshaft, one end thereof being inserted into the rotational body and the camshaft including a cam located on an outer periphery of the camshaft to open the engine valve against a spring force exerted by a valve spring of the engine valve; a phase changing device interposed between the rotational body and the one end of the camshaft to hydraulically vary a relative rotational phase between the rotational body and the camshaft; a hydraulic pressure circuit to relatively supply and drain a hydraulic pressure to and from at least one retardation angle hydraulic pressure chamber and at least one advance angle hydraulic pressure chamber, each hydraulic pressure chamber being formed within the rotational body to drive the cam phase changing device; and an interrupting mechanism to interrupt: a hydraulic pressure passage of the hydraulic pressure circuit to supply the hydraulic pressure to at least one of the advance angle and retardation angle hydraulic pressure chambers for a time duration which corresponds to a torque peak region of a rotation variation torque developed on the camshaft.

BEST MODE FOR CARRYING OUT THE INVENTION

Reference will hereinafter be made to the drawings in order to facilitate a better understanding of the present invention.

(First Embodiment)

Figure 1:
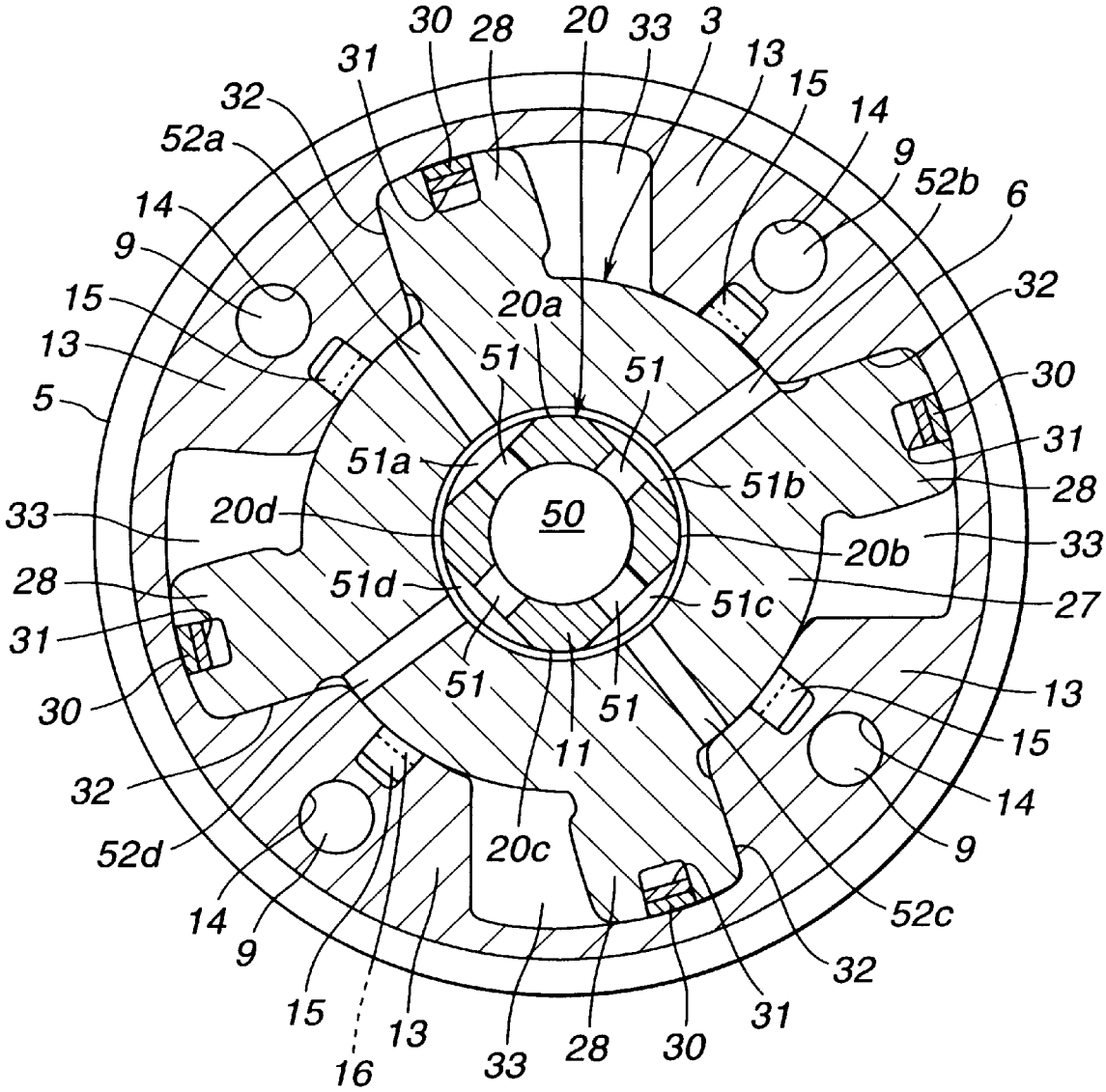
FIG. 1 is a cross sectional view cut away along a line of A—A in FIG. 3.
Figure 2:
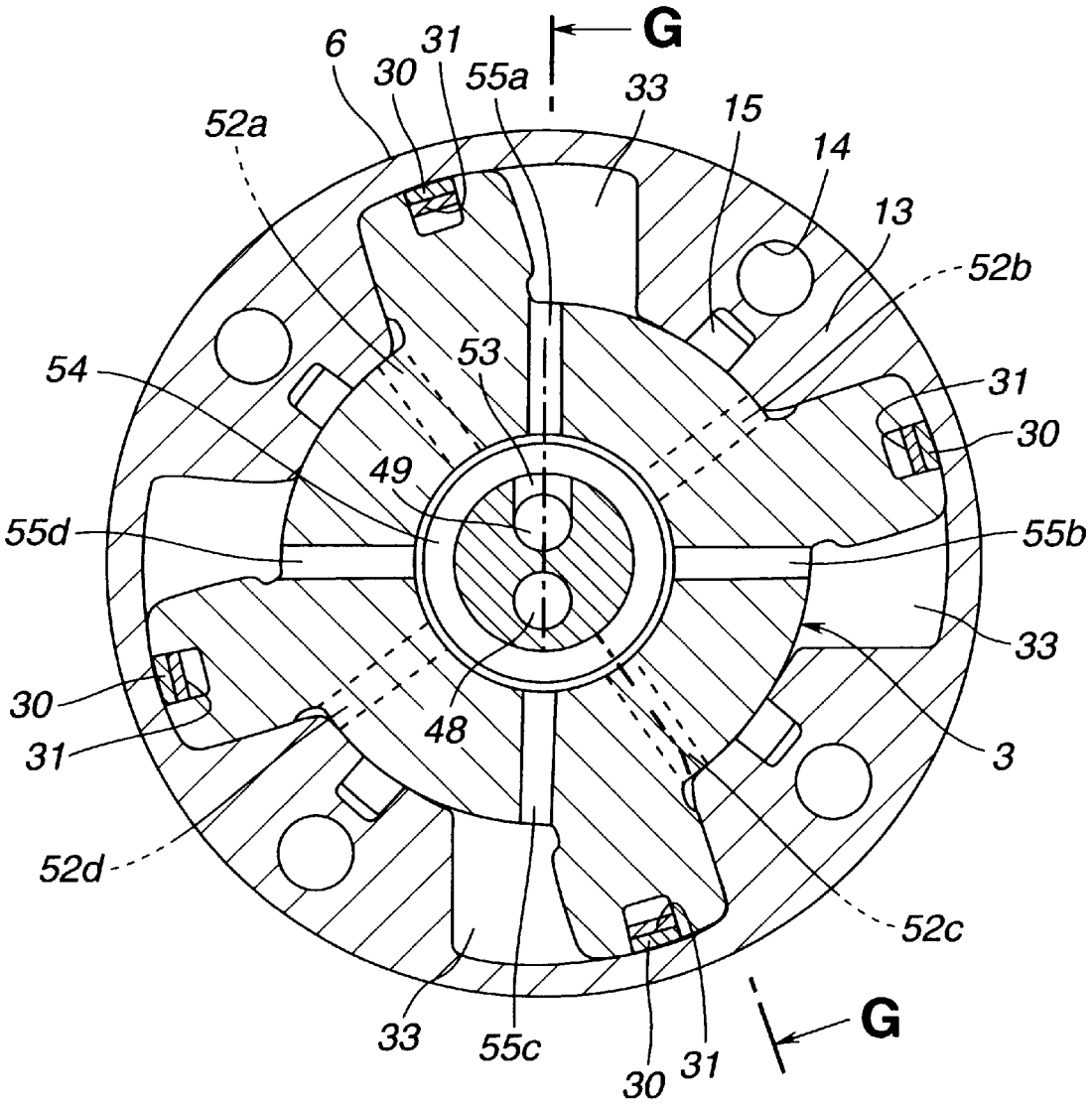
FIG. 2 is another cross sectional view cut away along a line of B—B in FIG. 3.
Figure 3:
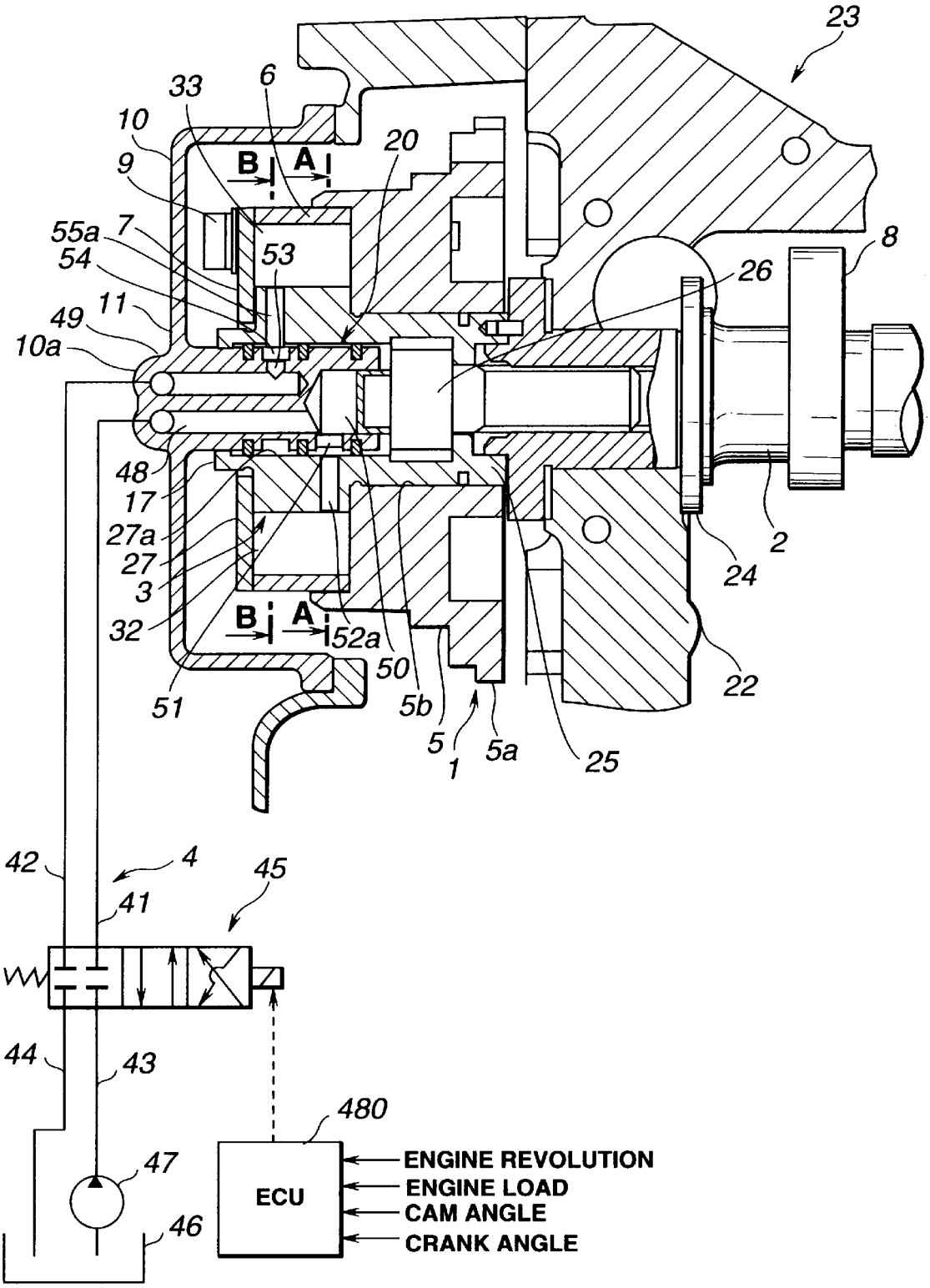
FIG. 3 is a longitudinal cross sectional view cut away along a line of G—G in FIG. 2 for explaining a first preferred embodiment of a variable valve timing controlling apparatus according to the present invention.

FIGS. 1, 2, and 3 show a first preferred embodiment of a variable valve timing controlling apparatus for an internal combustion engine applicable to an intake valve of an in-line four cylinder engine or of a one-bank four cylinder of V-type eight cylinder internal combustion engine.

In details, the variable valve timing controlling apparatus in the first embodiment includes: a timing sprocket 1 which constitutes a rotational body rotationally driven by means of a crankshaft (not shown) of the engine via a timing chain; a camshaft 2 disposed so as to enable a relative rotation thereof to the timing sprocket 1; a vane 3 rotatably housed within a timing sprocket 1 and fixed to the end of the camshaft 2; a hydraulic pressure circuit 4 constructed to enable the vane 3 to rotate in either a normal or reverse direction according to a hydraulic pressure of the vane 3; a cylindrical passage constituting section 11 fixed on a front end of the engine, projected in a center direction of the vane 3, and located at an inner side of a chain covering 10 covering the timing chain wound between the timing sprocket 1 and a drive sprocket (not shown) of the crankshaft (not shown); and an interrupting mechanism 20 formed on the passage constituting section 11 and temporarily interrupts a part of the hydraulic pressure circuit 4.

It is noted that the vane 3 constitutes a cam phase changing device.

In details, the timing sprocket 1 includes, as shown in FIG. 3, a rotational member 5 having a tooth section 5*a* at an outer peripheral portion of the member 5 with which the timing chain is meshed; a cylindrical housing 6 disposed on a front portion of the rotational member 5 and in which the vane 3 is rotatably housed; and a circular front covering 7 which constitutes a lid to close the front end opening of the housing 6.

These rotational member 5, the housing 6, and the front cover 7 are integrally joined from an axial direction by means of four small-diameter bolts 9.

The rotational member 5 is of an approximately ring shape as shown in FIGS. 1 through 3. Four female screen holes on which respective small-diameter bolts 9 are screwed are penetrated at equal interval positions of about 90° in the peripheral direction of an inner peripheral surface of the housing 6. In addition, a fitting hole 5*b* into which a sleeve 25 as will be described later is fitted is penetrated at an inner center position of the rotational member 5. The housing 6 is cylindrically shaped and has an opening at the front and rear ends as shown in FIGS. 1 and 2.

Four partitioning wall sections 13 are projected at each 90° interval position in the peripheral direction of the inner peripheral surface of the housing 6. Each partitioning wall section 13 is of a trapezoid shape of cross section as shown in FIG. 1. Each partitioning wall section 13 is disposed along the axial direction of the housing 6. Each front and rear end edge of the partitioning wall section 13 is in the same surface as the corresponding end edge of the housing 6. Four bolt inserting holes 14 through which the small-diameter bolts 9 are inserted are penetrated in the axial direction.

Furthermore, a letter-U shaped seal member 15 and a plate spring 16 to press the seal member 15 in the inner direction are fitted into a retaining groove located at a center position of an inner end surface of each partitioning wall portion 13.

Then, the front covering 7 has an inserting hole 17 with a relatively large diameter at a center position and four bolt holes are fitted into positions corresponding to respective bolt inserting holes 14 of the housing 6.

The camshaft 2 is rotatably supported on a cylinder head 22 via a camshaft bearing 23. A cam 8 which opens the intake valve at a predetermined position of an outer peripheral surface via a valve lifter (not shown) is integrally disposed and a flange section 24 is integrally disposed on a front end section of the cam shaft 2.

The vane 3 is integrally formed of a sintered alloy material, as shown in FIGS. 1 and 2. The vane 3 is provided with the sleeve 25 fitted into the fitting hole 5*b*. The vane 3 is fixed onto a front end of the camshaft 2 by means of a bolt 26 inserted into the vane 3 from its axial direction through the sleeve 25. The vane 3 further includes a rotor section 27 in a circular ring shape having an inserting hole 27*a* at a center thereof through which the bolt 26 is inserted; and four (first through fourth) blade sections 28 integrally formed at 90° intervals in the peripheral direction of an outer peripheral surface of the rotor 27.

Each of four blade sections 28 is formed of a rectangular shape in cross section and is disposed between each partitioning wall portion 13.

The letter-U shaped seal member 30 and the plate spring 31 pressing the seal member 30 externally are fitted and retained on the retaining groove cut out in the axial direction at the center of each outer peripheral surface of the blade portions 28. The letter U-shaped seal member 30 is slid against the inner peripheral surface 6*a* of the housing 6, respectively. In addition, four advance angle hydraulic pressure chambers 32 and four retardation angle hydraulic pressure chambers 33 are defined between both sides of the respective blade portions 28 and both sides of the respective positioning wall sections 13.

The hydraulic circuit 4, as shown in FIG. 3, includes a first hydraulic pressure passage 41 which supplies and exhausts (drains) the hydraulic pressure to and from the advance angle hydraulic pressure chamber 32; and a second hydraulic pressure chamber 33. Both of the first and second hydraulic pressure passages 41 and 42 are connected to a hydraulic pressure supply passage 43 and a hydraulic pressure drain passage 44 via an electromagnetic switching valve 45. The electromagnetic switching valve 45 is a control valve for switching the passages as will be described later. The supply passage 43 is provided with an oil pump 47 which supplies an oil within an oil pan 46 under a pressure. A downstream end of the drain passage 44 is communicated with the oil pan 46.

Figure 4:
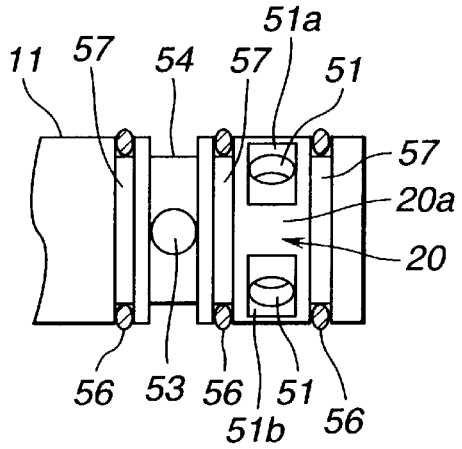
FIG. 4 is a front view of a passage constituting section shown in FIG. 1.

The first and second hydraulic pressure passages 41 and 42 include projected wall sections 10*a* located at a center of the chain covering 10 and first and second passage sections 48 and 49 formed in parallel with each other (juxtaposed) in an axial direction of the passage constituting section 11. The first passage section 48 for the advance angle side is communicated with each advance angle side hydraulic pressure chamber 32 via four first communication holes 51 fitted into its radial direction at 90° position in the peripheral direction from the hydraulic pressure chamber 50 at the tip end of the passage constituting section 11 and four first hydraulic pressure passages 52*a*, 52*b*, 52*c*, and 52*d* formed radially within the rotor section 27. On the other hand, the second passage section 49 is communicated with each retardation angle hydraulic pressure chamber 33, as shown in FIG. 2, via a single communication hole 53 whose tip is fitted radially within the passage constituting section 11, a groove 54 formed on an outer periphery of the second passage hole 53, and four second hydraulic pressure passages 55*a*, 55*b*, 55*c*, and 55*d* formed radially within the rotor section 27. It is noted that these seal ring grooves 57 are formed on both sides of the groove 54 and on one end of the first communication hole 51 and the seal rings 56 are fitted into the respective seal ring grooves 57, as shown in FIG. 4.

The interrupting mechanism 20 is constituted by four interrupting surfaces 20*a*, 20*b*, 20*c*, and 20*d* formed by means of an outer peripheral surface of the passage constituting section 11 between each opening end 51*a*, 51*b*, 51*c*, and 51*d* mutually adjoining to the four first communication holes 51 and cut out horizontally. The interrupting surfaces 20*a*, 20*b*, 20*c*, and 20*d* are faced sequentially so as to close each opening end of the first hydraulic pressure passages 52*a*, 52*b*, 52*c*, and 52*d*.

Figures 6A, 6B, 6C:
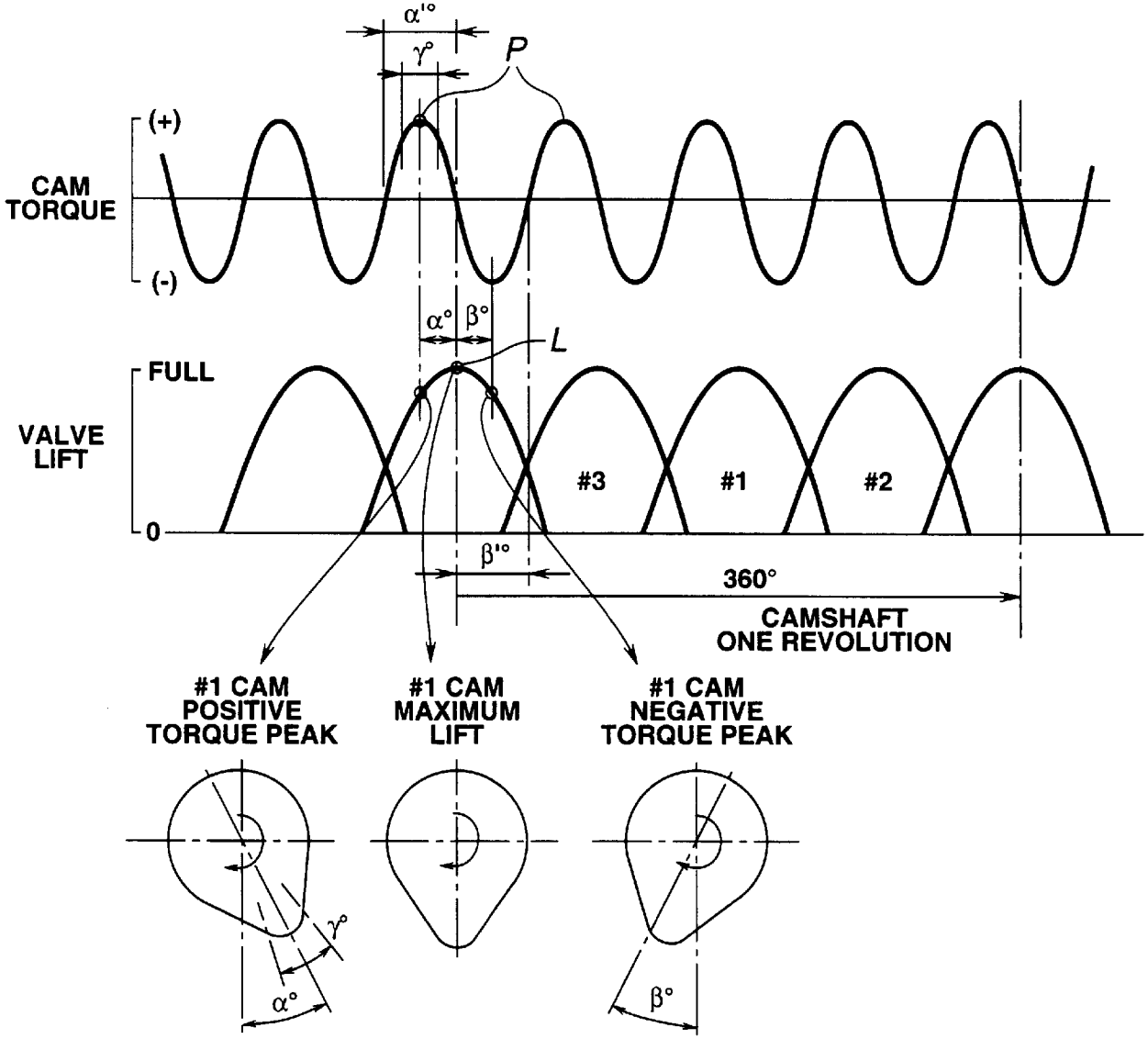
FIGS. 6A, 6B, and 6C are graphs of a rotation variation characteristic of a camshaft, a valve lift characteristic, and a rotational position of a cam corresponding to FIGS. 6A and 6B, respectively.

In general, the positive and negative rotation variation torque developed on the camshaft: 2 due to a reaction force of the valve spring of the intake valve are repeated for every 90° per rotation of the camshaft 2 in the case of the in-line four cylinder engine (as well as one bank in the V-type eight cylinder engine). The relative positional relationship between the rotation variation torque, the valve lift of the intake valve, and the rotated position of the cam 8 is shown in FIGS. 6A, 6B, and 6C. As shown in FIGS. 6A through 6C, the positive variation torque is started to be developed before a position of L which is a maximum lift point of the cam 8 and continues through an angle range of $\alpha'°$. A maximum value of the positive torque corresponds to a start point of a given angle of $\alpha°$ and a maximum range of the positive torque corresponds to a predetermined angular range of $\gamma°$ before and after the given range of $\alpha°$. In addition, the negative variation torque is developed over a predetermined angle range of $\beta'°$ after the cam 8 has passed the maximum lift point of L.

Figures 7A, 7B, 7C, 7D:
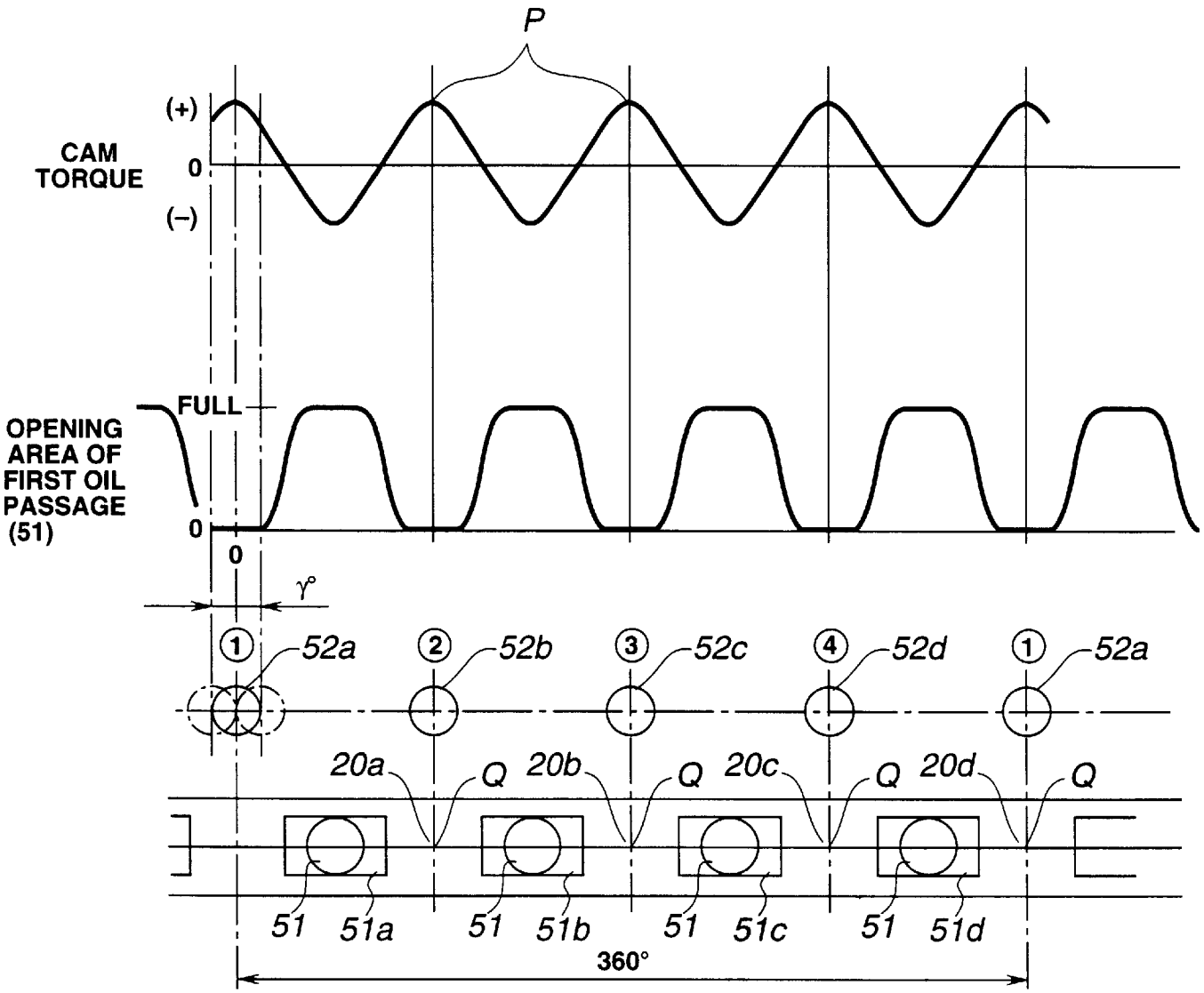
FIGS. 7A, 7B, 7C, and 7D are graphs of a rotation variation torque characteristic (so-called, a cam torque) and an opening area of a first hydraulic pressure passage, a position indicating diagram of the first hydraulic passage in the relationship with respect to an interrupting surface, and an expanded view of an interrupting mechanism, respectively.

The above-described interrupting surfaces (lands in the claims) 20*a*, 20*b*, 20*c*, and 20*d* are set in accordance with the positive rotation variation torque. Specifically, the interrupting surfaces 20*a* through 20*d* are determined according to a length between each opening end 51*a* through 51*d* cut out in a rectangular form in the peripheral direction of each first communication hole 51. A center Q in its elongated direction of each communication passage 52*a* through 52*d* is set to a position corresponding to a for-and-aft region with a torque peak P of the positive rotation variation torque developed on the cam shaft 2 in a center and a center of each first hydraulic pressure passage 52*a* through 52*d* is set to be coincident with the center Q. Hence, an opening area of the opening end of the first communication hole 51 is, as shown in FIGS. 7A, 7B, and 7C, set to have a characteristic of approximately a trapezoid shape such that the opening area of the opening end of the first communication passage 51 gives maximum in a negative torque region in which the vane 3 is rotated in the advance angle side direction.

The electromagnetic switching valve 45 is of a four-port, two-position type, as shown in FIG. 3. A valve body of the valve 45 serves to relatively control the switching between each hydraulic pressure passage 41 and 42 and each of the hydraulic pressure passage 43 and the drain passage 44 in accordance with a control signal from a controller 480. Although the electromagnetic switching valve 45 relatively switches between the supply passage 43 and the drain passage 44, the switching operation thereof is carried out in a very short time or continually. The controller 480 includes a microcomputer, detects a present driving condition of the engine according to the output signals of a crank angle sensor to detect an engine speed and of an airflow meter to detect the intake air quantity, and detects relative pivotal position between the timing sprocket 1 and the camshaft 2 according to the output signals of the crank angle and the cam angle sensor.

Next, an operation of the first preferred embodiment of the variable valve timing controlling apparatus will be described below.

First, when the controller 480 determines that the engine is started or that the engine is in an idling condition, the electromagnetic switching valve 45 is switched to communicate the hydraulic pressure supply passage 43 with the second hydraulic pressure passage 42 and to communicate the drain passage 44 with the first hydraulic pressure passage 41. Hence, the hydraulic pressure derived from the oil pump 47 is supplied to the retardation angle hydraulic pressure chambers 33 via the second hydraulic pressure passage 42. On the other hand, the hydraulic pressures of the advance angle hydraulic pressure chambers 32 are maintained each under a low pressure state since no hydraulic pressure is given to these chambers in the same way as the case where the engine is stopped.

Therefore, in the vane 3, each blade section 28 is brought in contact with one side end surface of each partitioning wall section 13 faced toward the advance angle hydraulic pressure chambers 32.

Hence, the relative pivotal position between the timing sprocket 1 and the camshaft 2 is held at one side (retardation angle side) so that the open-and-closure timing of the intake valve is controlled to be transferred to the retardation angle direction. Consequently, a combustion efficiency can be improved by a utilization of an inertia intake air and a stability of engine revolutions and fuel consumption can be improved.

Thereafter, when the controller 480 determines that, with the vehicle started, the engine driving condition is transferred from a low-engine-speed-and-low-engine-load region to a normal middle-engine-speed-and-middle-engine-load region, the controller 480 outputs another control signal to the electromagnetic switching valve 45 communicating the hydraulic pressure supply passage 43 with the first hydraulic pressure passage 41 and communicating the drain passage 44 with the second hydraulic pressure passage 42.

Figure 5:
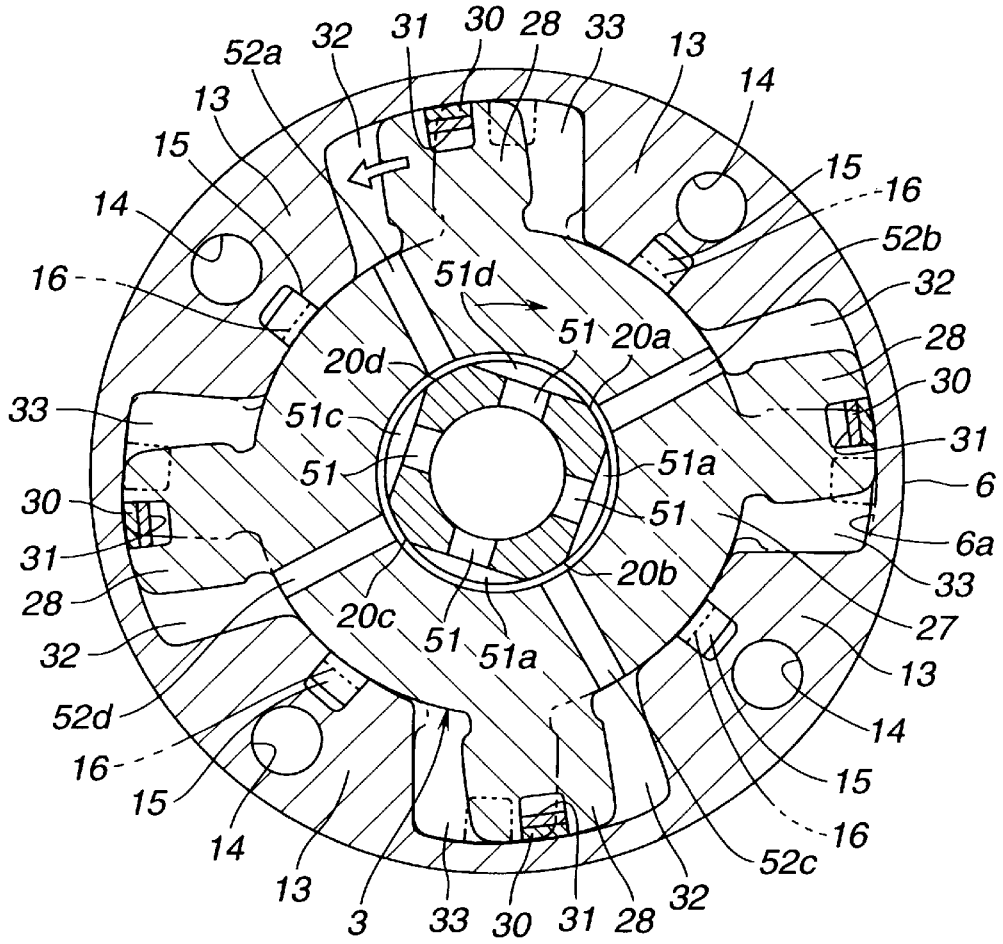
FIG. 5 is a cross sectional view cut away along a line of A—A shown in FIG. 3 for explaining an operation of the variable valve timing controlling apparatus according to the present invention.

Hence, the working oil (hydraulic pressure) within each retardation side hydraulic pressure chamber 33 is returned (drained) to the oil pan 46 via the drain passage 44 and the second hydraulic pressure passage 22 so that the hydraulic pressure within each retardation angle hydraulic pressure chamber 33 becomes lowered and the hydraulic pressure is supplied via the first hydraulic pressure passage 41 to provide a high pressure for each advance angle hydraulic pressure chamber 32. Hence, the vane 3 is rotated in a clockwise direction as shown in FIG. 5 so that each blade section 28 is rotated up to a maximum advance angle position at which each blade section 28 is brought in close contact with another side surface of the respective partitioning wall sections 13 which is opposite to the retardation angle side hydraulic pressure chambers 33.

Hence, the timing sprocket 1 and camshaft 2 are relatively rotated toward the other side direction so that the open-and-closure timing of the intake valve is controlled in the advance-angle direction.

During the rotation of the vane 3 linked to the camshaft 2, the positive variation torque generation region from among the positive and negative rotation variation torque developed on the camshaft 2, especially at the predetermined angular region of γ° of the torque peak P described above, any one of the interrupting surfaces 20*a*, 20*b*, 20*c*, and 20*d* closes the opening end of the first hydraulic passages 52*a*, 52*b*, 52*c*, and 52*d* so that the communication between the first hydraulic passages 52*a*, 52*b*, 52*c*, and 52*d* and the first communication passages 51 is interrupted so that the respective advance angle side hydraulic pressure chambers 32 are hermetically sealed.

Therefore, even if the positive variation torque acts on the rotation force in the opposite direction (arrow marked direction in FIG. 5) to the advance angle side with respect to the vane 3, the reverse flow of the hydraulic pressure within the advance angle side hydraulic chamber 32 is positively limited so that the temporal reverse rotation of the vane 3 can be prevented.

Figures 8A, 8B, 8C:
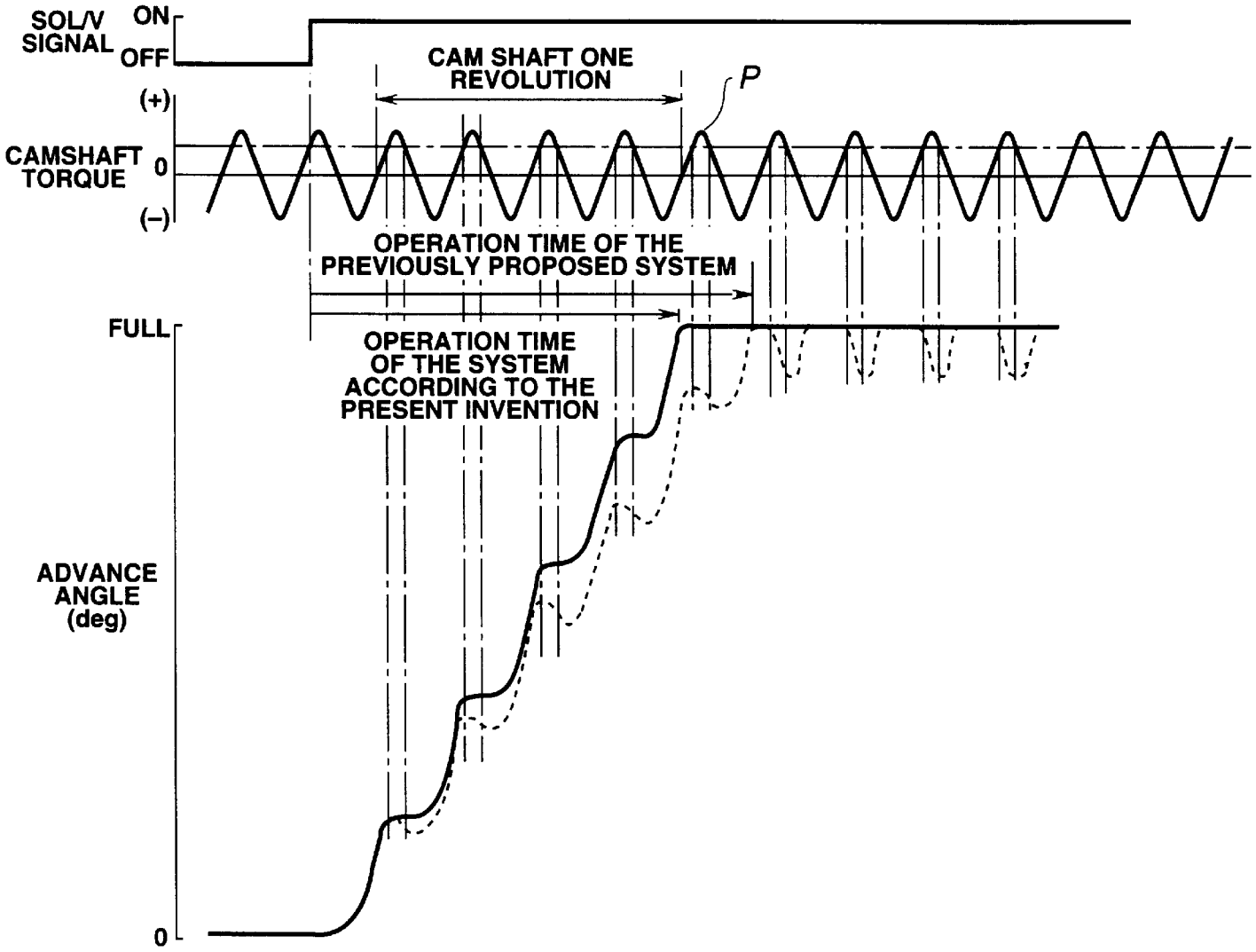
FIGS. 8A, 8B, and 8C are characteristic graphs representing a relationship between the rotation variation torque of a camshaft and the rotation operation of the vane toward the advance angle.

Hence, the vane 3 is rotated in the advance angle direction in a stepwise manner as denoted by a solid line of FIG. 8C without reverse rotation of the vane 3 as is different from the second previously proposed variable valve timing control apparatus (denoted by the broken line in FIG. 8C). Even under such a relatively low or middle engine revolution region that the drain (discharge) pressure of the oil pump 47 is relatively low, the vane 3 can quickly be rotated in the advance angle direction. Consequently, since the relative rotation velocity between the timing sprocket 1 and the camshaft 2 is raised, the control response characteristic of the valve open-and-closure timing is improved.

It is noted that since the negative rotation variation torque acts as a force to assist the rotation of the vane 3 in the advance angle direction, the control response characteristic of the valve open-and-closure timing is furthermore improved. In addition, since each opening end 51*a*, 51*b*, 51*c*, and 51*d* of the first communication hole 51 is formed in the rectangular shape in the peripheral direction, its both end edges open and close progressively the circular opening ends of the first hydraulic pressure passages 52*a*, 52*b*, 52*c*, and 52*d*, the abrupt open and closure operations by means of the interrupting surfaces 20*a*, 20*b*, and 20*d* of the opening ends can be suppressed so that a ripple of the hydraulic pressure within the first hydraulic pressure passage 41 can be prevented.

Next, when the controller 480 determines that the engine driving condition is transferred from the middle engine-speed-and-middle-engine-load region to a high-engine-speed-and-high-engine-load region, the controller 480 outputs the control signal to switch the operation of the electromagnetic switching valve 45, thus, the electromagnetic switching valve 45 communicating the first hydraulic pressure passage 41 with the drain passage 44 and communicating the second hydraulic pressure passage 42 with the supply passage 43. Hence, while the working oil within the advance angle hydraulic pressure chambers 32 is drained from the first hydraulic pressure passage 41 within the oil pan 46 so that the advance angle hydraulic pressure chambers 32 are in the low pressure state but the hydraulic pressure is supplied to the retardation angle hydraulic pressure chambers 33 so as to become a high pressure state. Hence, the vane 3 is rotated in a counterclockwise direction and is positioned as shown in FIGS. 1 and 2. The relative rotation between the timing sprocket 1 and the camshaft 2 in the retardation angle direction occurs so that the open-and-closure timing of the intake valve is controlled in the retardation angle direction. Consequently, an intake air charging efficiency is improved and an output of the engine is accordingly increased.

It is noted that each opening end 51*a*, 51*b*, 51*c*, and 51*d* in the first preferred embodiment may be formed over an outer peripheral surface of the passage constituting section 11.

(Second Embodiment)

FIGS. 9 through 16C show a second preferred embodiment of the variable valve timing controlling apparatus according to the present invention applicable to the in-line four cylinder engine.

It is noted that a hydraulic pressure stream route of the hydraulic pressure in the hydraulic pressure circuit 4 and the structure of the interrupting mechanism 20 are different from those of the first embodiment.

In addition, in the second embodiment, no limitation is placed on the number of blade sections of the vane, as is different from the first embodiment.

Figure 9:
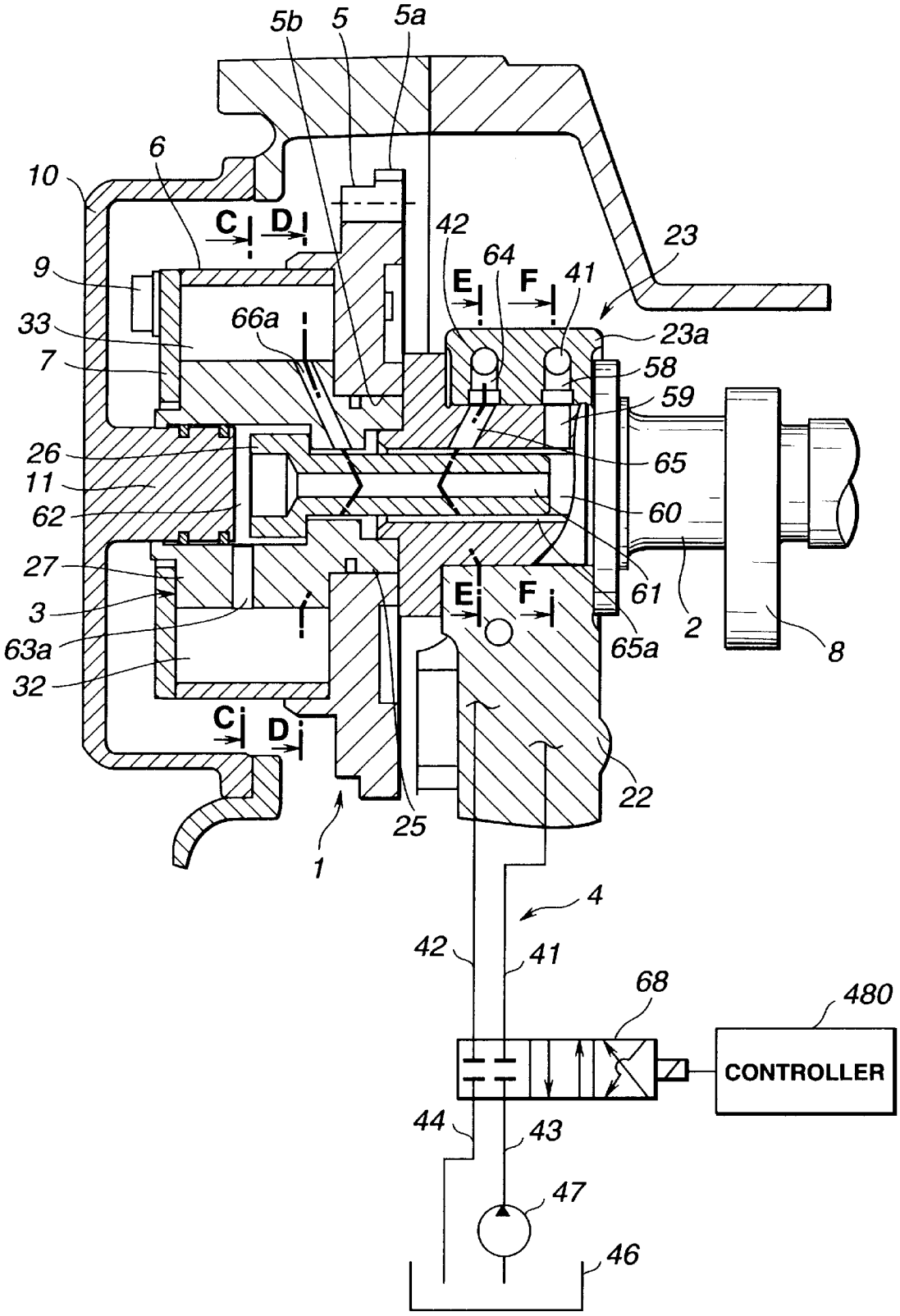
FIG. 9 is a longitudinal cross sectional view of a second preferred embodiment of the variable valve timing controlling apparatus according to the present invention.
Figure 10:
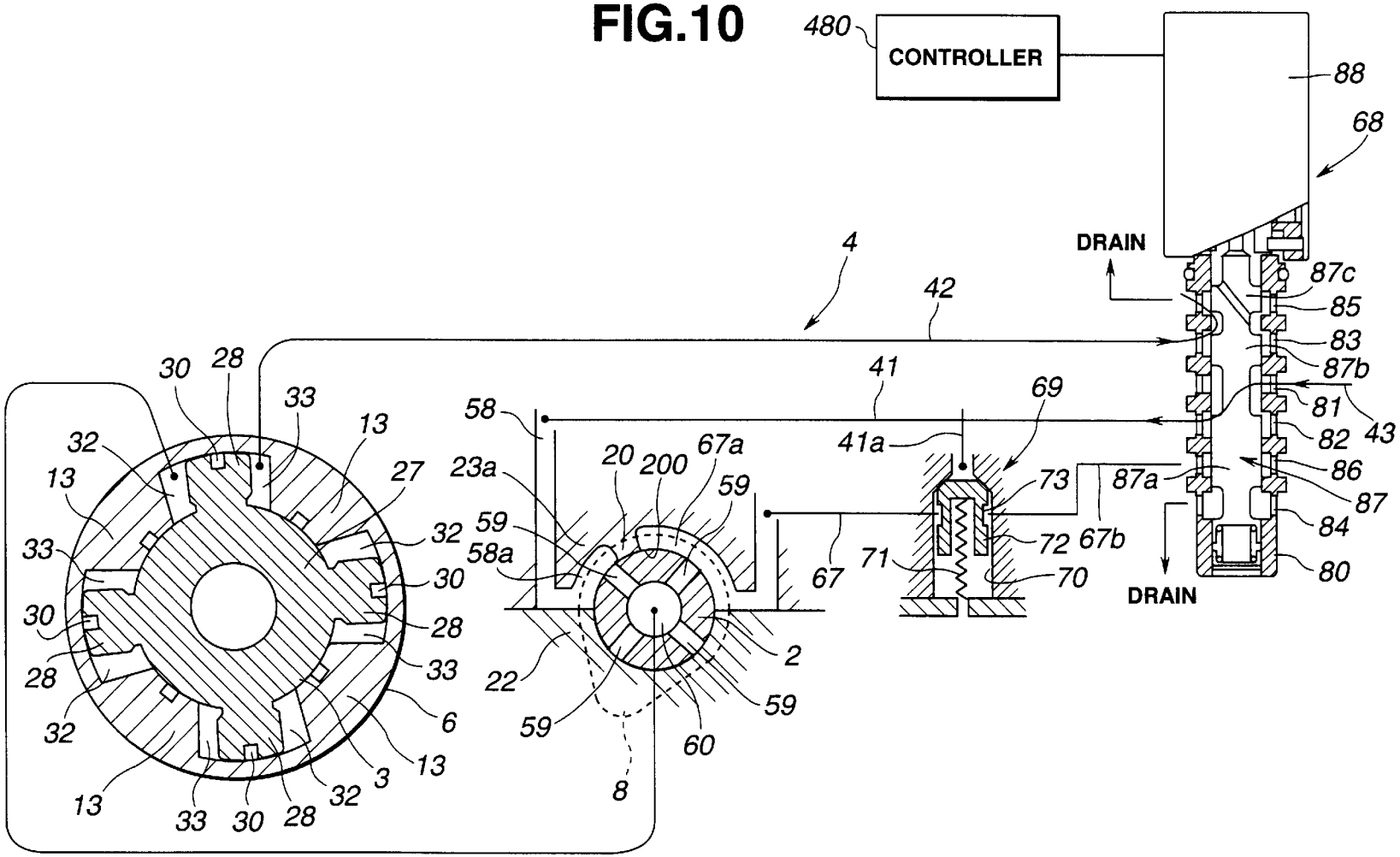
FIG. 10 is a rough view of essential part of a hydraulic pressure circuit and its peripheral structure in the second preferred embodiment shown in FIG. 9.

The first hydraulic pressure passage 41 of the hydraulic pressure circuit 4 includes a first passage section 58 formed within a cylinder head 22 and within a bracket 23*a* of a cam bearing 23, as shown in FIGS. 9 and 10.

The first hydraulic pressure passage 41 includes four radial holes 59 formed symmetrically in a cross shape on the camshaft 2. The first hydraulic pressure passage 41 further includes a cylindrical hole 60 formed on an axial center of the camshaft 2. The first hydraulic pressure passage 41 further includes a bolt passage section 61 penetrated in an inner axial direction of the bolt 28 to communicate the cylindrical hole 60 with a hydraulic pressure chamber located on a bolt head. The first hydraulic pressure passage 41 further includes four first hydraulic pressure passages 63*a*, 63*b*, 63*c*, and 63*d* formed within the rotor section 27 along a radial direction of the rotor section 27 to communicate the above-described bolt head hydraulic pressure chamber 62 with the respective advance angle hydraulic pressure chambers 32. In addition, the first passage section 58 has an arc-shaped end 58*a* formed on an inner peripheral surface of the cam bracket 23*a* set in an angular range of about 60° along an outer peripheral surface of the camshaft 2 from an upper surface of the cylinder head 22.

Figure 13:
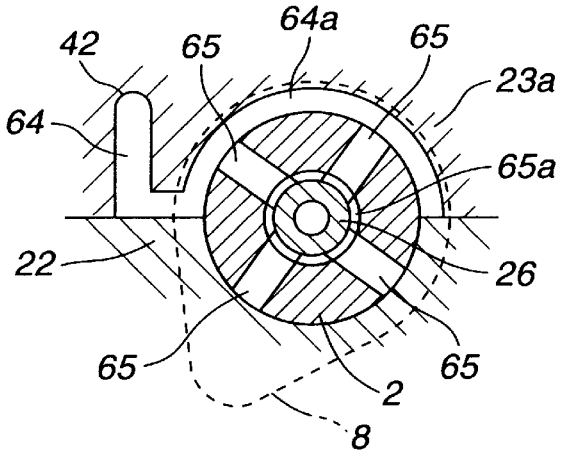
FIG. 13 is a cross sectional view cut away along a line of E—E shown in FIG. 9.

On the other hand, the second hydraulic pressure passage 42 includes a second passage section 64 formed approximately in parallel to the first passage section 58. As shown in FIGS. 9 and 10, the second hydraulic pressure passage 42 further includes four second hydraulic pressure passages 66*a* slanted from within the sleeve 25 into the inner part of the rotor section 27 to communicate the circular passage 65*a* with the retardation angle hydraulic pressure chambers 33. In addition, the second passage section 64 has the end 64*a* formed on the inner peripheral surface of the cam bracket 23*a*. This end 64*a* is, as shown in FIG. 13, formed in a semi-arc shape of 180° along the inner peripheral surface of the cam sprocket and is always communicated to any one of the above-described radial holes 65.

On the other hand, the hydraulic pressure circuit 4 includes a bypass passage 67 bypassing the interrupting mechanism 20 to be communicated with the advance angle hydraulic pressure chambers 32. The bypass passage 67, as shown in FIG. 10, serves to communicate the electromagnetic switching valve 68 with the radial hole 59 and is always communicated with the advance angle hydraulic pressure chamber 32. In addition, the bypass passage 67 is interrupted when the first hydraulic pressure passage 41 is communicated with the supply passage 43 by means of the electromagnetic valve 68. The bypass passage 67 is communicated with the drain when the first hydraulic pressure passage 41 and the supply passage 43 are interrupted by means of the electromagnetic valve 68. It is noted that the open or closure of the bypass passage 67 is carried out by means of the electromagnetic switching valve 68 which opens or closes the first hydraulic pressure passage 41 and the second hydraulic pressure passage 42.

In addition, the end 67*a* of the bypass passage 67 located at the side of the cam bracket 23*a* is formed in an arc shape having an arc angle of about 100° along the outer peripheral surface of the camshaft 2. The end 67*a* of the bypass passage 67 is always communicated with any one of the radial holes 59 at any rotational position.

Furthermore, a bypass valve 69 is disposed in a midway through the bypass passage 67. The bypass valve 69 includes a valve hole 70 to which a branch passage 41*a* branched from the first hydraulic pressure passage 41 is connected; a coil spring 71; and a plunger valve body 72 which closes a connection end of the branch passage 41*a* by means of a spring force of the coil spring 71. A circular groove 73 which communicates with an upstream-and-downstream flow of the bypass passage 67 is formed on an outer peripheral surface of the valve body 72.

The interrupting mechanism 20 is projected between the end 58*a* of an inner peripheral surface of the cam bracket 23*a* and the end 67*a* of the bypass passage 67, as shown in FIG. 10. Its inner surface of the interrupting mechanism 20 provides the interrupting surface 200 which closes the opening end of each radial hole 59.

Figures 14A, 14B, 14C, 14D, 14E:
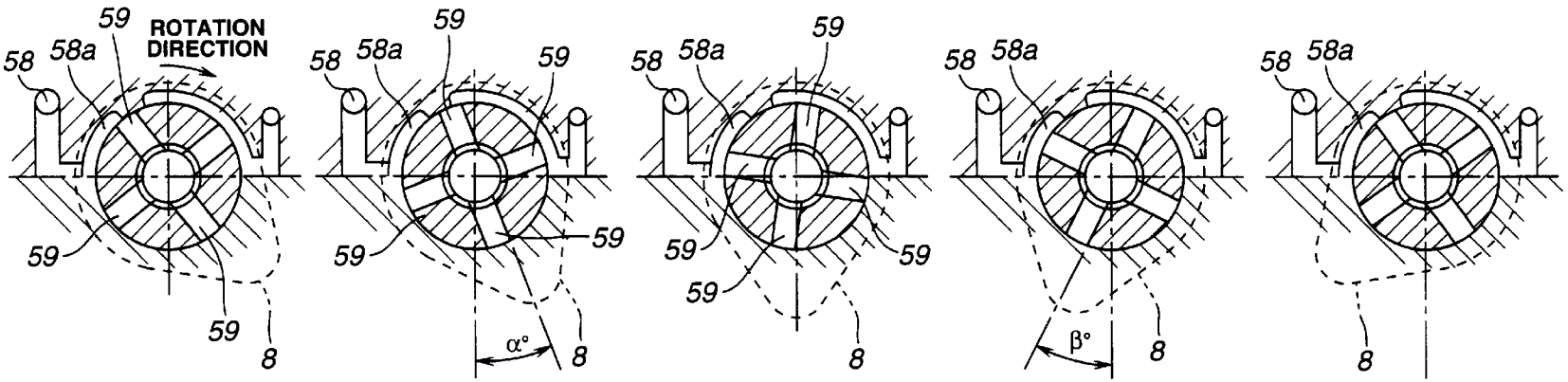
FIGS. 14A, 14B, 14C, 14D, and 14E are cross sectional views each cut away along a line of F—F shown in FIG. 9 for explanatorily representing an operation of an interrupting mechanism in the second embodiment shown in FIGS. 12 and 13.
Figures 15A, 15B:
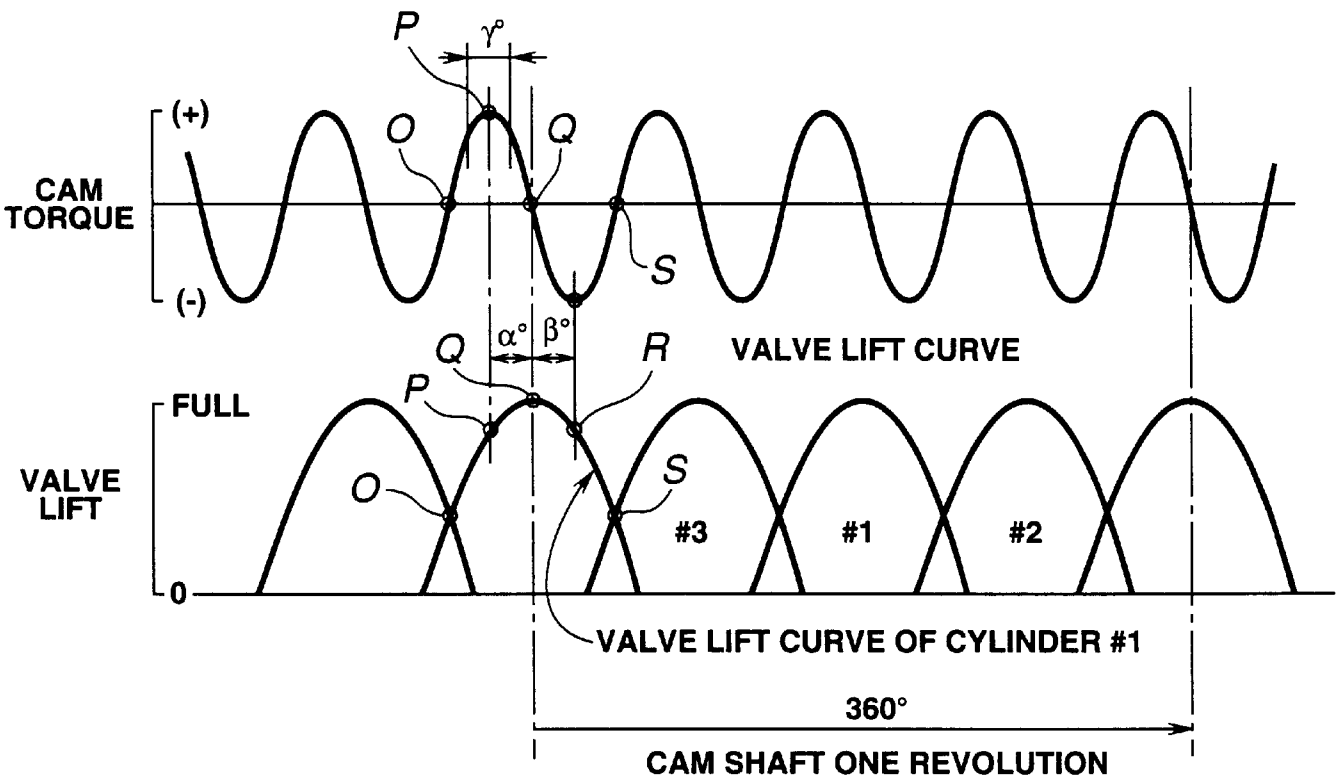
FIGS. 15A and 15B are a characteristic graph representing a rotation variation torque of a cam shaft and a valve lift characteristic graph corresponding to the rotation variation torque.

This interrupting surface 200 is set to have the whole opening end of the radial holes 59 over the predetermined positive peak angular region γ° of the rotation variation torque of the camshaft 2 as shown in FIGS. 15A and 15B in the same manner as the first preferred embodiment. In details, if the rotation variation torque of the camshaft 2 developed due to the rotation of the cam 8 shown in FIG. 15A and the valve lift characteristic shown in FIG. 15B are considered together with the positional relationship between the interrupting surface 20*a* and the radial holes 59 due to the rotation position of the cam shown in FIGS. 14A through 14E, the positive variation torque is developed over the region of γ° before and after the point P in the midway through the valve lift and indicates the torque peak at a point P. Hence, the interrupting region of the radial holes 59 due to the interrupting surface 200 is set in such a manner that the radial holes 59 are closed by about half of each opening end of the radial holes 59 in a vicinity to the zero positive torque as shown in FIG. 14A. At a positive peak region in the vicinity to the point P, the interrupting region is set in such a manner that the radial holes 59 are completely closed at the positive peak region P as shown in FIG. 14B. At a maximum lift region (FIG. 14C) in which no variation torque occurs, at a negative torque region (FIG. 14D), and at a zero torque region (FIG. 14E), the closure of the radial holes 59 by means of the interrupting surface 20*a* is released and the radial holes 59 are open.

On the other hand, the end 67*a* of the bypass passage 67 is set to be always communicated with any radial holes 59 even at any rotational position of the cam 8.

Furthermore, the electromagnetic valve 68 is constituted by a five-way valve as shown in FIG. 10.

A supply port 81 at which the working oil is supplied under a pressure, first and second communication ports 82 and 83 with which the first and second hydraulic pressure passages 41 and 42 are communicated, second drain ports 84 and 85 located at both ends of a valve body 80, and a third communication port 86 which is communicated with the bypass passage 67 are formed on a peripheral wall of a cylindrical valve body 80.

In addition, a spool valve body 87 is slidably disposed in an axial direction within a valve body 80. One elongated valve port 87*a* relatively opens or closes the first and third communication ports 87*b* and 87*c* and the first drain port 84. On the other hand, other two relatively short valve parts 87*b* and 87*c* relatively open or closes the second communication port and the second drain port 85. In addition, a slide position of the spool valve body 87 is controlled by means of an electromagnetic actuator 88 which is operated by means of the same controller 480 as in the case of the first embodiment.

Figure 11:
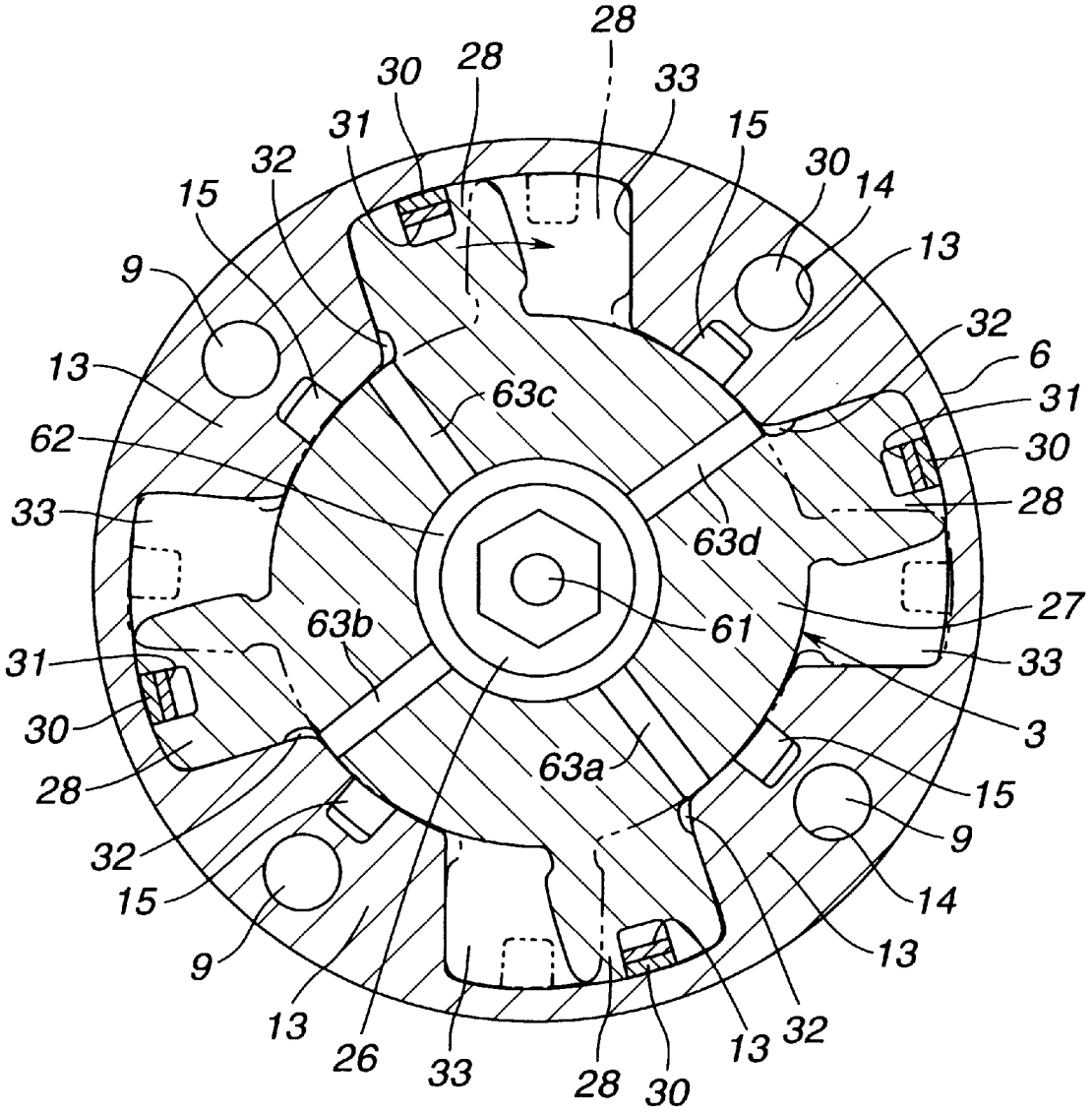
FIG. 11 is a cross sectional view cut away along a line of C—C shown in FIG. 9.
Figure 12:
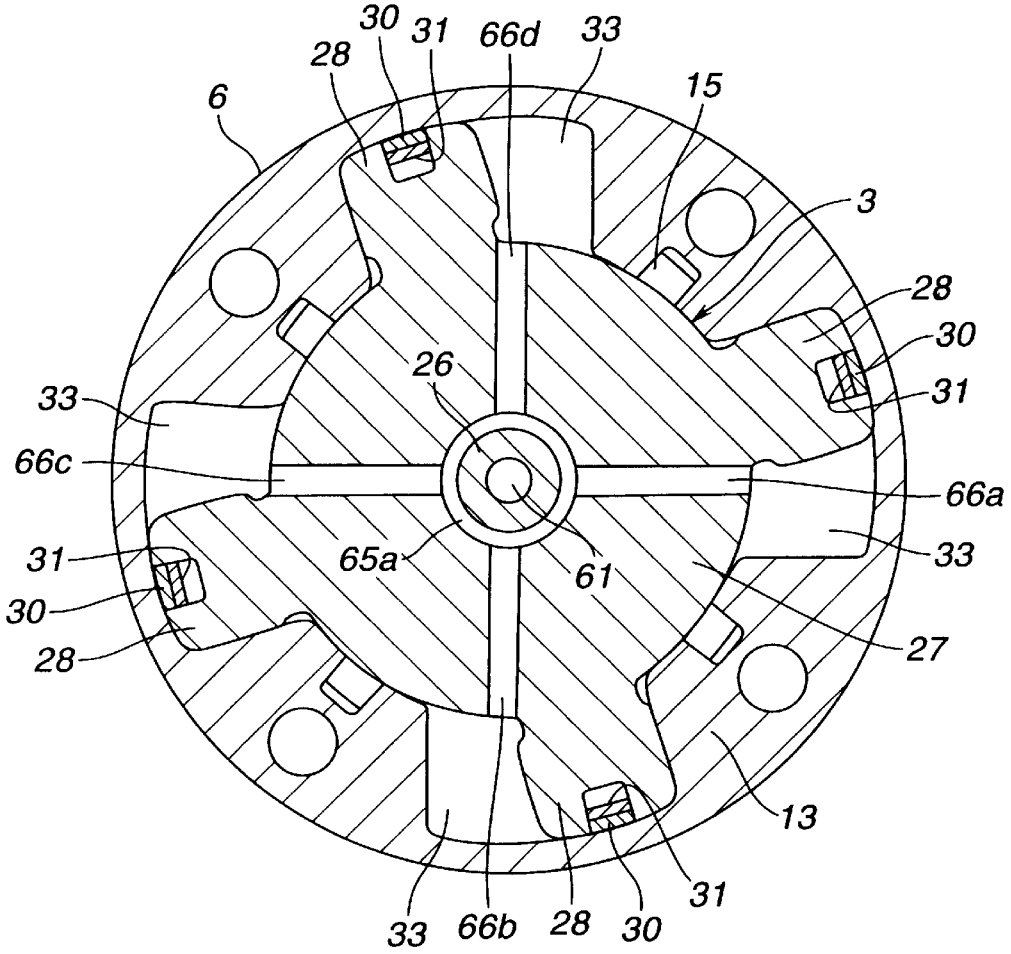
FIG. 12 is a cross sectional view cut away along a line of D—D shown in FIG. 9.

Hence, since, in the second embodiment, the switching operation on each part by means of the electromagnetic switching valve 68 during the engine operation and during the engine idling is supplied from the second hydraulic passage 42 to the retardation angle hydraulic chambers 33. Hence, the vane 3 is rotated, as shown in FIGS. 11 and 12, until each blade section 28 is brought in contact with one side surface of each partitioning wall section 13 located at the retardation angle hydraulic pressure chambers 32. Therefore, the relative rotation position between the timing sprocket 1 and the camshaft 2 is held at the retardation angle side so that the open-and-closure timing of the intake valve is controlled toward the retardation angle side.

Thereafter, when the engine driving condition is transferred from the low-engine-and-low-engine-load region to the middle-engine-speed-and-middle-engine-load region, the electromagnetic switching valve 68 is operated to communicate the supply passage 43 with the first hydraulic pressure passage 41 and to communicate the drain passage 41 with the second hydraulic pressure passage 42.

The hydraulic pressure within the advance angle hydraulic pressure chambers 32 is drained -to the oil pan 46 and the working oil (the hydraulic pressure) is supplied to the advance angle side hydraulic pressure chambers 32 so that the hydraulic pressure therewithin is raised. Consequently, the vane 3 is rotated in the direction toward the retardation angle hydraulic pressure chambers 33. Therefore, the relative rotation phase between the timing sprocket 1 and the camshaft 2 is converted to the other side (advance angle side) and the open-and-closure timing of the intake valve is controlled toward the advance angle side.

Then, when the working oil (the hydraulic pressure) is supplied to the advance angle side hydraulic pressure chambers 32, at the torque peak (predetermined angular) region of $\gamma°$ of the positive rotation variation torque of the camshaft 2, the opening ends of the radial holes 59 are closed by means of the interrupting surface 200. Hence, the positive rotation variation torque causes the reverse flow of the working oil in the advance angle hydraulic pressure chambers 32 to be limited and a temporal reverse rotation of the vane 3 to the advance angle hydraulic chambers 32 is prevented (in the counterclockwise direction). Hence, the vane 3 is quickly rotated in the stepwise manner in the advance angle direction without repetition of the normal and reverse rotations and denoted by the solid line of FIG. 16C.

Consequently, the control response characteristic of the variable valve open-and-closure timing controlling apparatus in the second embodiment can be improved.

It is noted that even though the positive rotation variation torque causes the advance angle hydraulic pressure 32 to become high, the prevention of the reverse flow of the working oil (the hydraulic pressure) to the first hydraulic pressure passage 41 can be assured. In addition, since the bypass passage 67 is also closed by means of the electromagnetic switching valve 68, no reverse flow at the bypass passage 67 occurs. Hence, almost no reverse flow at the bypass passage 67 occurs. Hence, no influence of the rotation of the vane 3 in the advance angle direction is given.

Furthermore, when the engine has reached to a middle-engine-speed region near to a high-engine-speed region, the hydraulic pressure passing the first hydraulic pressure passage 42 also becomes high. The hydraulic pressure presses down the bypass valve 69 from the branch passage 41*a* against the spring force of the spring 71 so that the bypass passage 67 is communicated with the branch passage 41*a*. The hydraulic pressure is supplied to the advance angle hydraulic pressure chambers 32 utilizing the bypass passage 67. This high hydraulic pressure becomes larger than the torque peak value of the positive rotation variation torque.

Figures 16A, 16B, 16C:
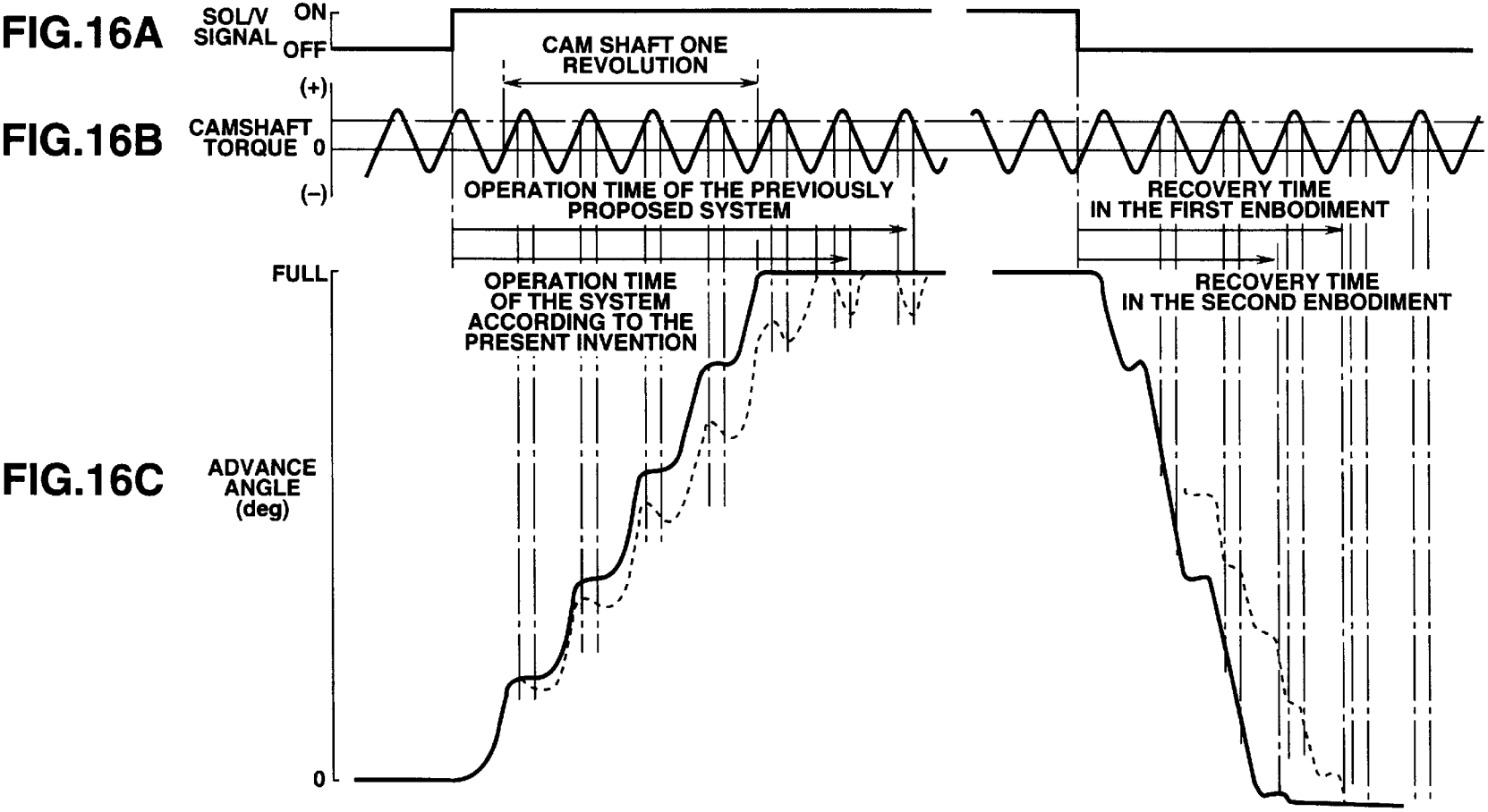
FIGS. 16A, 16B, and 16C are characteristic graphs respectively representing the relationship between the camshaft rotation variation torque and the rotation operation of the vane in the second embodiment shown in FIGS. 12 and 13.

Hence, the vane 3 is stably and accurately held at a rotational position at a maximum advance angle side as denoted by a solid line placed at an uppermost part of FIG. 16A (in FIG. 11 a phantom line portion).

At this time, the electromagnetic switching valve 68 interrupts the communication between the bypass passage 67 and the drain passage (DRAIN in FIG. 10).

On the other hand, when the engine driving condition is transferred to a high-engine-speed-and-high-engine-load region, the electromagnetic switching valve 68 is operated so that the first hydraulic pressure passage 41 is interrupted in the same way as the case of the engine start, the bypass passage 67 is communicated with the drain passage 44 via the first drain port, and the second hydraulic pressure passage 42 is communicated with the supply passage 43.

Hence, the bypass valve 72 is raised according to the spring force of the spring 71 to close the branch passage 41*a* and is communicated with the upstream and downstream flow sections of the bypass passage 73 via a circular passage 73. Hence, the working oil (the hydraulic pressure) within the advance angle hydraulic chambers 32 is drained through the bypass passage 67. The drain (exhaust) of the hydraulic pressure (working oil) is speedily carried out and a reduction velocity of the hydraulic pressure to the advance angle hydraulic pressure chambers 33 becomes high. The recovery revolution velocity of the vane 3 from the advance angle to the retardation angle becomes sufficiently high as compared with the case denoted by the broken line, as shown by the solid line of FIGS. 16A through 16C. Consequently, the control response characteristic of the variable valve timing controlling apparatus in both of the advance and retardation angle sides can be improved.

It is noted that the term of temporarily means for a time duration which corresponds to a torque peak region of the rotation variation torque developed on the camshaft.

The entire contents of two Japanese Patent Applications No. Heisei 10-285800 (filed on Oct. 8, 1998) and No. Heisei 11-255131 (filed on Sep. 9, 1999) are incorporated herein by reference.

Although the invention has been described above by reference to certain embodiments of the invention, the invention is not limited to the embodiments described above, Modifications and variations of the embodiments described above will occur to those skilled in the art in light of the above teachings. For example, in the second embodiment, in a case where the present invention is applied to a V-type six-cylinder internal combustion engine having one bank of three cylinders, the number of vanes 3 may be three and it is possible to form the radial holes 59 of the camshaft 2 by three in its circumferential direction of 120°. In addition, the electromagnetic switching valve 68 may be held at an arbitrary intermediate position by interrupting the first and second hydraulic pressure passages 41 and 42, the supply passage 43, and the drain passage 44, and the vane 3 may be held at an arbitrary intermediate position. Furthermore, according to the magnitude relationship in the positive and negative variation torque, the same interrupting mechanism 20 may also be installed in the second hydraulic pressure passage 42. A cylindrical gear may be installed in place of the vane as a position converter.

The scope of the invention is defined with reference to the following claims.

What is claimed is:

1. A variable valve timing controlling apparatus for an internal combustion engine having an engine valve, comprising:

a rotational body rotated in synchronization with an engine crankshaft;

a camshaft, one end thereof being inserted into the rotational body and the camshaft including a cam located on an outer periphery of the camshaft to open the engine valve against a spring force exerted by a valve spring of the engine valve;

a cam phase changing device interposed between the rotational body and the one end of the camshaft to hydraulically vary a relative rotational phase between the rotational body and the camshaft;

a hydraulic pressure circuit to relatively supply and drain a hydraulic pressure to and from at least one retardation angle hydraulic pressure chamber and at least one advance angle hydraulic pressure chamber, each hydraulic pressure chamber being formed within the rotational body to drive the cam phase changing device; and an interrupting mechanism to interrupt a hydraulic pressure passage of the hydraulic pressure circuit to supply the hydraulic pressure to at least one of the advance angle and retardation angle hydraulic pressure chambers for a time duration which corresponds to a torque peak region of a rotation variation torque developed on the camshaft.

2. A variable valve timing controlling apparatus for an internal combustion engine having an engine valve as claimed in claim 1, wherein the interrupting mechanism is interposed in a midway through the hydraulic pressure passage and further comprises a bypass passage, the bypass passage bypassing the interrupting mechanism and being interrupted when the hydraulic pressure is supplied from the hydraulic pressure chambers and wherein, when the hydraulic pressure within the corresponding one of the advance angle and the retardation angle hydraulic pressure chambers is drained toward an external to the apparatus whose pressure is lower than the hydraulic pressure in the corresponding one of the advance angle and retardation angle hydraulic pressure chambers, the hydraulic pressure passage is interrupted and the bypass passage is communicated with the external to the apparatus.

3. A variable valve timing controlling apparatus for an internal combustion engine having an engine valve as claimed in claim 2, further comprising a bypass valve interposed in the bypass passage to communicate an upstream side of the hydraulic pressure passage with the bypass passage when the supplied hydraulic pressure at an upstream side of the hydraulic pressure passage with respect to the interrupting mechanism is equal to or higher than a predetermined pressure.

4. A variable valve timing controlling apparatus for an internal combustion engine having an engine valve as claimed in claim 1, wherein the hydraulic pressure passage includes: a plurality of hydraulic pressure passage sections formed within an inner side of a cylindrical passage constituting section fixed on the engine, each hydraulic pressure passage section having an opening end on an outer peripheral surface of the passage constituting section; and a plurality of radial holes extended radially in an inner side of the cam phase changing device, each radial hole having one opening end and the opening end being communicated with the corresponding one of the respective opening ends of the hydraulic pressure passage sections, and having the other ends, each of the other ends being communicated with the corresponding one of the advance angle and retardation angle hydraulic pressure chambers and wherein the interrupting mechanism comprises a plurality of lands, each land being formed on a corresponding one of the outer peripheral surface of the cylindrical passage constituting section between the corresponding mutually adjacent opening ends of the respective hydraulic pressure passage sections.

5. A variable valve timing controlling apparatus for an internal combustion engine having an engine valve as claimed in claim 1, wherein the hydraulic pressure passage includes: a hydraulic pressure passage section extended from an inner part of a bearing of the camshaft and opened on an inner peripheral surface of the bearing of the camshaft; and a plurality of radial holes extended radially within the camshaft along a radial direction of the camshaft one opening end of each radial hole being enabled to be communicated with the hydraulic pressure passage section and wherein the interrupting mechanism includes a projection section projected from an inner peripheral surface of the bearing of the camshaft to face against an outer peripheral surface of the camshaft including at least one of the opening ends of the respective radial holes.

6. A variable valve timing controlling apparatus for an internal combustion engine having an engine valve as claimed in claim 4, wherein the torque peak region of the rotation variation torque developed on the camshaft is a predetermined angular range $\gamma°$ with a positive torque peak point P of a positive rotation variation torque developed on the camshaft as a center.

7. A variable valve timing controlling apparatus for an internal combustion engine having an engine valve as claimed in claim 6, wherein a plurality of rectangular shaped opening ends are formed on the outer peripheral surface of the cylindrical passage constituting section between the respectively adjacent lands of the interrupting mechanism, each rectangular shaped opening end being enabled to communicate each of the hydraulic pressure passage sections with the corresponding one of the radial holes in the inner side of the cam phase changing device and wherein a center Q of each land of the interrupting mechanism is set to become coincident with the positive peak point P of the positive variation torque developed on the camshaft and to become coincident with a center of the corresponding one end of the respective radial holes and a length between one end and the other end of each land is set to include the predetermined angular range $\gamma°$ with the positive torque peak point P of the positive torque peak point P of the positive rotation variation torque developed on the camshaft as the center.

8. A variable valve timing controlling apparatus for an internal combustion engine having an engine valve as claimed in claim 7, the other end of each radial hole is communicated with the corresponding advance angle hydraulic pressure chamber, each advance angle hydraulic pressure chamber being defined by one side surface of a corresponding one of a plurality of blade sections of the cam phase changing device and one side surface of a corresponding one of a plurality of partitioning wall sections integrally formed by a cylindrical housing of the rotational body in which the cam phase changing device is rotatably housed.

9. A variable valve timing controlling apparatus for an internal combustion engine having an engine valve as claimed in claim 8, further comprising another hydraulic pressure passage including: a plurality of other hydraulic pressure passage sections formed within the inner side of the cylindrical passage constituting section, each of the other hydraulic pressure passage sections having an opening end on the outer peripheral surface of the passage constituting section; and a plurality of other radial holes extended radially in the inner side of the cam phase changing device, each of the other radial hole having one opening end and the opening end being communicated with the corresponding one of the respective opening ends of the hydraulic pressure passage sections, and having the other ends, each of the other ends being communicated with the corresponding retardation angle hydraulic pressure chambers, each retardation angle hydraulic pressure chamber being defined by the other side surface of the corresponding one of the blade sections of the cam phase changing device and the other side surface of the corresponding one of the partitioning wall sections integrally formed by the cylindrical housing of the rotational body.

10. A variable valve timing controlling apparatus for an internal combustion engine having an engine valve as claimed in claim 9, wherein the phase changing device comprises a vane.

11. A variable valve timing controlling apparatus for an internal combustion engine having an engine valve as claimed in claim 5, wherein, when the projection section faces against the one opening end of the radial holes, any other one of the opening ends of the radial holes is communicated with the bypass passage.

12. A variable valve timing controlling apparatus for an internal combustion engine having an engine valve as claimed in claim 11, wherein the torque peak region of the rotation variation torque developed on the camshaft is a predetermined angular range $\gamma°$ with a positive torque peak point P of a positive rotation variation torque developed on the camshaft as a center and wherein, when the camshaft is rotated over the predetermined angular range $\gamma°$, the projection section of the interrupting mechanism has a surface area sufficient to completely close the one opening end of the respective radial holes with the bypass passage interrupted.

13. A variable valve timing controlling apparatus for an internal combustion engine having an engine valve as claimed in claim 12, further comprising an electromagnetic switching valve, the electromagnetic valve being operated to close the bypass passage via the bypass valve when the camshaft is rotated over the predetermined angular range $\gamma°$.

14. A variable valve timing controlling apparatus for an internal combustion engine having an engine valve as claimed in claim 13, wherein the electromagnetic switching valve is connected to a controller determining an engine driving condition and wherein, when the controller determines that engine driving condition falls in an engine start condition or an engine idling condition, the electromagnetic switching valve is operated to supply the hydraulic to each retardation angle hydraulic pressure chamber via a second hydraulic pressure passage (42) so that a relative rotational position between the rotational body (1) and the camshaft (2) is controlled to be maintained at a retardation angle side, thus an open-and-closure timing of an intake valve constituting the engine valve being controlled toward the retardation angle side.

15. A variable valve timing controlling apparatus for an internal combustion engine having an engine valve as claimed in claim 14, wherein, when the controller determines that the engine driving condition is transferred into a middle-engine-speed-and-middle-engine-load region from a low-engine-speed-and-low-engine-load region, the electromagnetic switching valve is operated to drain the hydraulic in each retardation angle hydraulic pressure chamber via the second hydraulic pressure passage and to supply the hydraulic to each advance angle pressure chamber via a first hydraulic pressure passage (41) constituting the hydraulic pressure passage to raise the hydraulic pressure in each advance angle hydraulic pressure chamber so that the relative rotational position between the rotational body and the camshaft is controlled to be at an advance angle side, thus the open-and-closure timing of the intake valve being controlled toward the advance angle side and, when the hydraulic is supplied to each advance angle hydraulic pressure chamber, the one opening end of the respective radial holes (59) is closed by the projection section of the interrupting mechanism and the bypass passage is closed by the electromagnetic switching valve for the time duration which corresponds to the predetermined angular range $\gamma°$ of the positive rotation variation torque developed on the camshaft.

16. A variable valve timing controlling apparatus for an internal combustion engine having an engine valve as claimed in claim 15, wherein a branch passage **(41*a*) to the bypass valve is interposed in the first hydraulic pressure passage at the upstream side with respect to the bypass passage section (58) and, when the controller determines that the engine driving condition falls in a high-engine-speed-and-high-engine-load region, the electromagnetic switching valve is operated to close the first hydraulic pressure passage, to communicate the bypass passage (67) with a drain passage (44), and to communicate the second hydraulic pressure passage with a hydraulic pressure passage (43)** and the bypass valve is operated to close the branch passage and to communicate the bypass passage with the drain passage to drain the hydraulic in each advance angle hydraulic pressure chamber via the bypass passage.

17. A variable valve timing controlling apparatus for an internal combustion engine having an engine valve as claimed in claim 16, wherein, when the controller determines that the engine driving condition falls in a middle-engine-speed region near to a high-engine-speed region, the hydraulic pressure in the first hydraulic pressure passage becomes equal to or higher than the predetermined hydraulic pressure and the bypass valve is pressed down against a spring force of a spring (71) to communicate the bypass passage with the branch passage so that the hydraulic pressure is supplied to each advance angle hydraulic chamber to raise the hydraulic pressure in each advance angle hydraulic pressure above a torque value at the positive peak point (P) of the positive rotation variation torque developed on the camshaft.

18. A variable valve timing controlling apparatus for an internal combustion engine having an engine valve as claimed in claim 17, wherein, when the controller determines that the engine driving condition falls in the middle-engine-speed region near to the high-engine-speed region, the electromagnetic switching valve is operated to interrupt the communication between the bypass valve and the drain passage which is external to the apparatus.

* * * * *